US006463862B1

(12) United States Patent
Kuhlman et al.

(10) Patent No.: US 6,463,862 B1
(45) Date of Patent: Oct. 15, 2002

(54) LABORATORY STATION

(75) Inventors: Charles E. Kuhlman, Chattanooga, TN (US); Joseph J. White, Collegedale, TN (US)

(73) Assignee: Collegedale Casework, Inc., Collegedale, TN (US)

( * ) Notice: Subject to any disclaimer, the term of this patent is extended or adjusted under 35 U.S.C. 154(b) by 0 days.

(21) Appl. No.: 09/687,001

(22) Filed: Oct. 12, 2000

(51) Int. Cl.[7] ..... A47B 37/00

(52) U.S. Cl. ..... 108/50.01; 108/25; 108/24; 108/50.11

(58) Field of Search ..... 108/24, 50.01, 108/50.18, 50.02, 50.13, 60, 61.25; 312/194, 230, 223.3, 223.2, 223.1

(56) References Cited

U.S. PATENT DOCUMENTS 312,999 A * 2/1885 Junod
D142,107 S * 8/1945 Morrey
5,437,235 A * 8/1995 Randolph ..... 108/25
5,746,488 A * 5/1998 Lacour ..... 312/223.3 X
5,758,934 A * 6/1998 Flutka et al. ..... 312/223.3
5,845,587 A * 12/1998 Ditonto ..... 108/50.01
D414,634 S 10/1999 Smith et al.
6,085,665 A 7/2000 Smith et al.

OTHER PUBLICATIONS

Sheldon brochure, p. 1.

* cited by examiner

*Primary Examiner*—Jose V. Chen
(74) *Attorney, Agent, or Firm*—Stephen J. Stark; Miller & Martin LLP

(57) ABSTRACT

A laboratory station has a sink area and a work area separated by a shield. A computer monitor station is present in the work area having a first and second position. In the first position, the computer monitor is located below the top surface of the laboratory table top. In the second position at least a portion of the computer monitor is located above the table top. The shield is preferably transparent to allow vision there through while preventing water from leaving the sink area and potentially entering the work area.

17 Claims, 2 Drawing Sheets

LABORATORY STATION

BACKGROUND OF THE INVENTION

The present invention relates generally to stations which are utilized in laboratories, such as industrial, government, health care, and education environments, to provide a work area for individuals, and, more particularly, to a laboratory station having a work area and a sink area. The work area preferably includes a monitor connected to a computer and the surface of the work area is preferably adjustable to accommodate users which are either standing or sitting. The work area is preferably shielded from the sink area.

DESCRIPTION OF THE RELATED ART

Laboratory stations are often utilized in industrial, government, health care, and education environments, including science classrooms, especially at the middle school and high school levels. Traditionally, the laboratory station has been a counter top connected to a fixed cabinet connected to a wall of a room. Students or workers could sit on either side of the table and have access to a sink there between.

One improvement to the traditional station has been developed by Sheldon Laboratory Systems as described in U.S. Pat. No. 6,085,665. Sheldon has developed a laboratory table having a work area which is adjustable in height. In the center of this work area is located a standard cathode ray tube (CRT) type computer monitor which is surrounded on five of its six sides by a shroud. This shroud is rotatable so that the monitor may be directed towards a particular location around the work area. The Sheldon work area is substantially semi-circular in shape with the sharp edges which would otherwise exist on a semi-circle rounded off. U.S. Design Pat. No. 414,634 is believed to be the laboratory table top utilized in this design. At the center of what would have been the diameter of the circle is where a second semi-circular shape is located somewhat smaller than the first semi-circular shape. The second semi-circular shape has a sink disposed therein and is directed opposite to the work area.

A plurality of Sheldon laboratory tables may be utilized in a classroom. In some classroom environments, students sit at the work area. The shroud around a CRT type computer monitor may obstruct the view of some students from the teacher and the view of the teacher from the teacher of certain students. This is believed to be a disadvantage. Furthermore, the shroud may protect the computer monitor from spills in the sink area, but the shroud will not protect other portions of the work area from spills.

Accordingly, a need exists to reduce the interference of a computer monitor for the visibility between students and teachers. Furthermore, the computer may not always be utilized and this obstruction may be a vision impediment. Additionally, even when the computer is being utilized, it is believed that a significantly improved field of view may be achieved. Additionally, protection of other portions of the work area may also be desired.

SUMMARY OF THE INVENTION

A need exists for a laboratory station having the capability of providing a computer monitor when necessary and having the option of moving the computer monitor when not in use so that the field of view between the teachers and students is not obscured.

Accordingly, the laboratory station of the preferred embodiment includes a work area and a sink area. The work area is preferably adjustable between at least two heights for standing use as well as for sitting use. A monitor platform is preferably housed within of a portion of the work area so set when the monitor platform is in the down position, the top of the monitor platform forms a substantially level surface on the work area with a table top. In an up position, the monitor platform preferably rises up out of the work area exposing at least a portion of a computer monitor above the table top. Additionally, a transparent shield is preferably located between the sink area and the work area to allow vision through the shield while protecting electronics associated with the computer monitor from water supplied around the sink area. Additionally, the shield protects other portions of the work area from potential spills and/or splashing from the sink area.

DETAILED DESCRIPTION OF THE DRAWINGS

Figure 1:
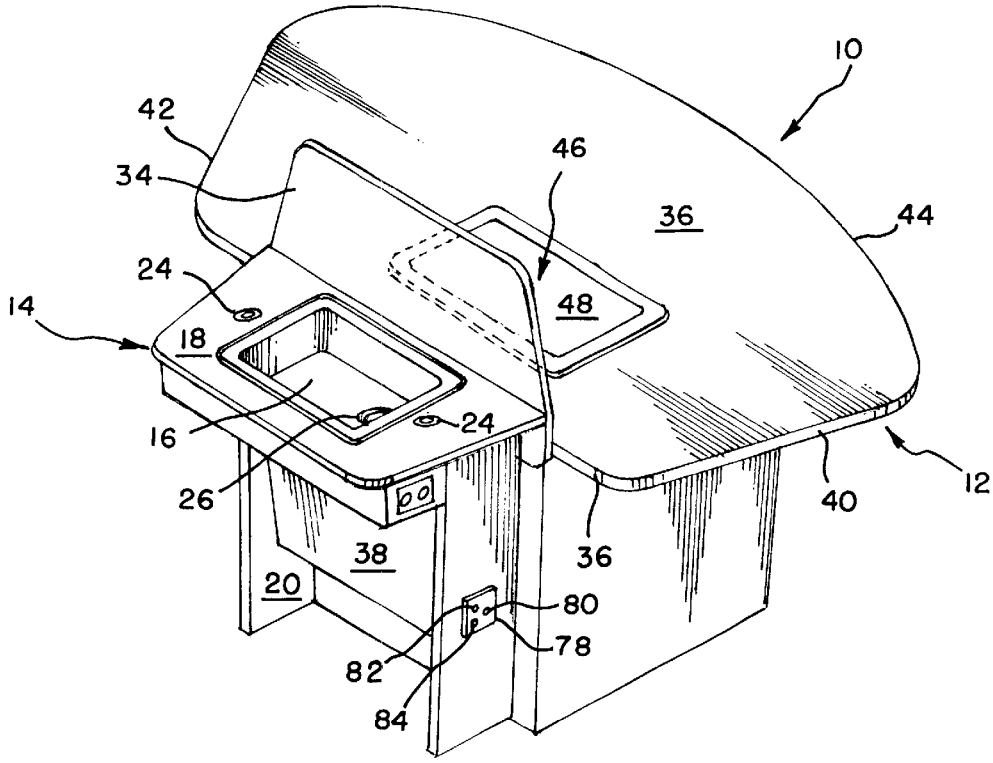
FIG. 1 is a front elevational view of a preferred embodiment of the laboratory station of the present invention showing the computer monitor station in a stored position and the laboratory table top in a lowered position.
Figure 2:
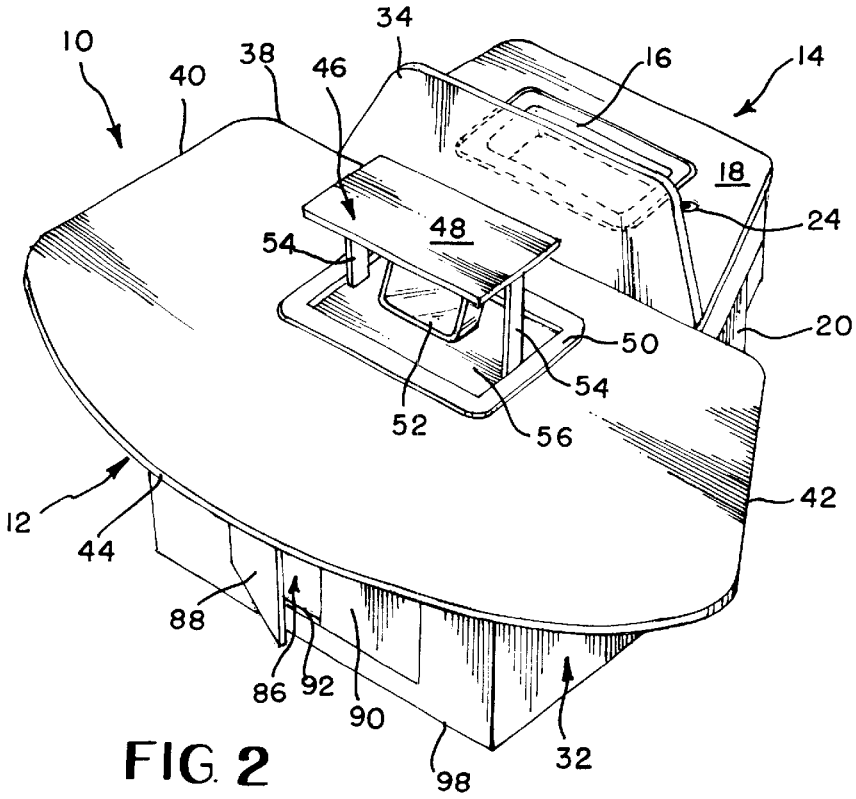
FIG. 2 is a back elevational view of the laboratory station of FIG. 1 with the computer monitor station in an operative position and the laboratory table top in a raised position.
Figure 3:
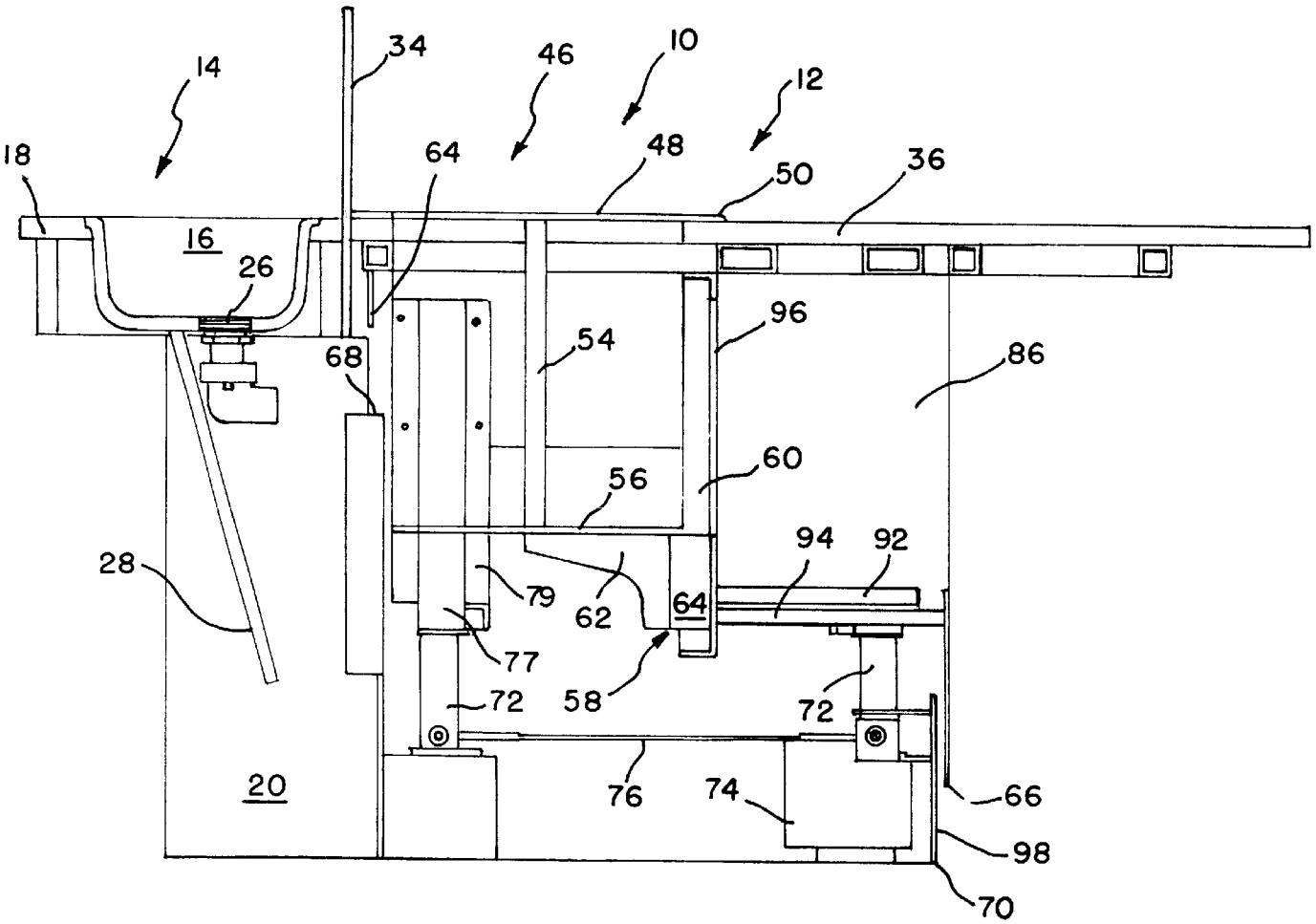
FIG. 3 is a cross sectional view of the laboratory station of FIG. 1.

FIGS. 1 and 2 are perspective views of the laboratory station 10 of the preferred embodiment. The laboratory station 10 is comprised of a work area 12 and a sink area 14. It is anticipated that at least one, and preferably a plurality of chairs and/or stools will be located around the work area 12. Individuals such as students or workers may utilize the work area 12 to perform class work, perform experiments, take notes, or perform other activities, whether authorized or unauthorized by a teacher and/or supervisor. Work of a similar or different nature may also be performed at the sink area 14. The sink area 14 has a sink 16 located therein. The sink is located below sink counter 18. Sink counter 18 is supported by sink supports 20, 22. Piping for the fluid supplies 24 and drain 26 of the sink 16 are located between sink supports 20, 22. The fluid supplies 24 may be utilized to supply water, gas or air at a pressure or vacuum. Various faucet designs may be utilized in conjunction with the fluid supplies 24. FIG. 3 shows an ADA compliant sink 16 constructed from epoxy resin installed in a one-inch epoxy resin top which forms the sink counter 18.

Returning to FIG. 1, the sink supports 20, 22 preferably adjoin a removable front face 28. The front face 28 is preferably angled relative to an individual that would be standing or sitting in front of the sink 16. This angled front face 28 may assist in meeting the ADA (Americans with Disabilities Act) requirements. The sink supports 20, 22 are preferably planar and located substantially perpendicular to a back face 30 of a base unit 32. In the preferred embodiment, the sink supports 20, 22 are the structural support of the sink 16.

The sink counter 18 abuts shield 34. The shield 34 may assist in separating the sink area 14 from the work area 12 and/or to minimize fluid entering the work area 12 from the sink area 14. The shield 34 may extend across the width of the sink area 14. The shield 34 may be constructed of shatter resistant material to reduce the likelihood that injury may result from a broken shield. One-half inch acrylic plate can be configured into a suitable shield 34. The shield 34 is preferably substantially trapezoidally shaped, however, other shapes may also be utilized. Furthermore, the shield 34 is preferably transparent allowing a person to see through the shield 34. This feature is believed to provide an advantage for students and teachers to be able to see one another through the shield 34.

The work area 12 is preferably comprised of a base 30 supporting a laboratory table top 36. The laboratory table top 36 is somewhat trapezoidally shaped. The table top 36 has four sides, a first, second, third, and fourth side 38, 40, 42, 44. The first side 38 is the side closest to the sink counter 18. The first side 38 is also the closest to the shield 34. The second and third sides 34,42 are angled relative to the first side 38. The fourth side 44 is curved and may provide a plurality of seating locations for students and/or users of the laboratory station 10. Furthermore, users may choose other seating locations around the table top 36 if so desired.

Within the work area 12 is located a computer monitor station 46. The computer monitor station 46 is shown in the down position in FIGS. 1 and 3. The top portion 48 of the computer monitor station 46 is substantially planar with a portion of the laboratory table top 36 in the preferred embodiment when in the down position. A no drip rim 50 may be utilized. If utilized, a ¼ inch×2 inch rim has been found effective and when the top portion 48 is in the down position it is approximately ¼ inch above the table top 36, but planar with rim 50. Accordingly, when the computer is not in use, the monitor 52 may be stored out of the way as shown. When a person, such as a student needs to utilize the computer, the computer monitor station 46 may be changed to an operative position as shown in FIG. 2.

When in the up position, the top portion 48 is preferably displaced to be parallel, but not planar, with the remainder of the laboratory table top 36 or rim 50, if utilized. In the preferred embodiment, the computer monitor 52 will rise up from within the base 32 to be visible to the users of the work area 12. A hinged connection or other system could also be utilized to allow for a monitor 52 to emerge from the unit 32. Two support legs 54 are illustrated supporting top portion 48. A flat LCD computer monitor has been found to be a preferred monitor 52, however, other monitor types may also be utilized. The computer monitor 52 rests on monitor support 56. The top portion 48 may be displaced in other than parallel relationship to the table top 36 in other embodiments.

The computer monitor station 46 may be operated by a lift system 58. The lift system 58 may be comprised of a guide 60 connected to an arm 62. The arm 62 may have a spring loaded sleeve 64 which travels about the guide 60 to locate between the open and closed positions illustrated in FIGS. 1 and 2. Some sewing machine stands have a mechanical lift for positioning a sewing machine above and below a table which operate similarly to the lift system 58.

The laboratory table top 36 is illustrated in an elevated position in FIGS. 2 and 3. The elevated position allows the table top 36 to be a greater distance from a floor than when in a lowered position as illustrated in FIG. 1. Extensions 64, 66 in FIG. 3 are illustrated a distance above positions 68 and 70, respectively. FIG. 3 reflects an elevated position of the table top 36. In a lower configuration the extension 64, 66 would be closer, if not proximate to positions 68, 70 respectively as illustrated in FIG. 1. By having an elevated and a lowered position, the table top 36 may be adjusted to accommodate users who are either standing or sitting on a variety of different height seats such as stools or chairs. Furthermore, having an adjustable height table top 36 allows for the positioning of the table top 36 to conform with wheel chair accessibility to allow a disabled person to wheel to a comfortable position below the table top 36 in accordance with ADA requirements.

The table top 36 preferably utilizes four electrically driven lifts 72 to allow for stable positioning of the table top 36. The use of four lifts has been found helpful in maintaining the stability of the table top 36 under various loading conditions. Of course, other lift and drive mechanisms including hydraulic cylinder lifts, hand operated crank drives and others could also be utilized.

If lifts 72 are utilized instead of slots and clamps, the table top 36 is stable at intermediate positions between the lowest and the highest positions. The lifts 72 preferably utilize at least one electric motor 74 which cooperates with gears coupled to extension members 76 to position the table top 36. When mechanical drive systems are utilized, components may include motor 74, gears and extension members 76 along a lower portion of base 30. Lift and drive mechanisms may also be in other positions relative to base 30. Extension arms 77 are illustrated connecting with support 79 at an upper portion of the base 30 or table top 36 to move the table top 36 up and down. A controller 78 for the lifts 72 is preferably connected to the base 32 and may have a key lock 80, up control 82 and down control 84. The controller 78 is in electrical communication with the electric motor(s) 74, if utilized.

The base 32 of the work area 12 preferably includes a storage area 86. Access doors 88, 90 may be utilized to access the storage area 86. Furthermore, a slide-out tray 92 may be utilized within the storage area to assist in accessing such equipment as computers, books or other materials housed within the storage area 86.

The storage area 86 is preferably constructed as a wooden insert 94 which fits within a metal housing 96. By using the insert cabinet construction, a variety of different cabinet configurations could be provided within a base 32 of the laboratory station 10. The preferred laboratory station 10 has a metal base 32. The cabinet or storage area 86 is an insert which fits within this metal base 32 during the construction of the station 10. Furthermore, the storage area 86 is preferably connected to the table top 36 such that when the table top 36 is moved between an elevated and lower position, the storage area 86 is also moved between the elevated and lower positions. Of course, in other embodiments it may be possible to have the insert 94 remain connected to a lower portion of the base 32 such as support 98 such that the insert 94 does not move with the movement of the table top 36.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. A laboratory station comprising a work area having a table top and a computer monitor station having a first and second position and a top portion with a top surface, said top portion configured to be located above a computer monitor when the computer monitor is installed in the computer monitor station, the first position of the computer monitor station locating the top surface in substantially planar relationship with the table top, the second position locating the top surface out of planar relationship with the table top.

2. The laboratory station of claim 1 further comprising a sink area located substantially adjacent to the work area.

3. The laboratory station of claim 2 further comprising a shield located between the sink area and the work area.

4. The laboratory station of claim 3 wherein the shield is substantially transparent.

5. The laboratory station of claim 1 wherein the laboratory table top is adjustable between at least two heights, an upper position and a lower position.

6. The laboratory station of claim 5 wherein the table top is stable at an intermediate position between the upper and lower positions.

7. The laboratory station of claim 1 wherein the top portion of the computer monitor station is displaced parallel to the table top when the computer monitor station is in the first position.

8. The laboratory station of claim 5 wherein the table top is located on top of a base.

9. The laboratory station of claim 8 wherein the base further comprises a plurality of lifts connected to the table top.

10. The laboratory station of claim 1 wherein the second position locates the top surface of the top portion of the monitor station parallel to and non-planar with the table top.

11. A laboratory station comprising:

a sink area having a sink extending below a sink counter, and at least one fluid supply providing a fluid to the sink;

a work area having a table top supported by a base, said work area connected to the sink area; and a substantially transparent shield located between the sink and the work area extending a distance above the table top and connected to at least one of the sink area and work area.

12. The laboratory station of claim 11 wherein the shield separates the table top from a top of the sink area.

13. The laboratory station of claim 12 wherein the work area further comprises a computer monitor station having a first and second position and a top portion with a top surface, said top portion configured to be located above a computer monitor when the computer monitor is installed in the computer monitor station, the first position of the computer monitor station locating the top surface substantially planar to the table top, the second position locating the top surface non-planar to the table top.

14. The laboratory station of claim 13 wherein the computer monitor station further comprises a computer monitor wherein said computer monitor is located below the table top when the computer monitor station is in the first position and the computer monitor is at least partially located above the table top in the second position.

15. The laboratory station of claim 13 wherein the top portion of the computer monitor station is displaced parallel, but not planar, with the table top when the computer monitor station is in the second position.

16. The laboratory station of claim 11 wherein the sink area has a width and the shield extends the width of the sink area.

17. The laboratory station of claim 13 wherein the table top is moveable between an elevated and a lowered position.

* * * * *